US011685984B2

(12) United States Patent
Dubois et al.

(10) Patent No.: US 11,685,984 B2
(45) Date of Patent: Jun. 27, 2023

(54) METHOD FOR CONTROLLING A COATING WEIGHT UNIFORMITY IN INDUSTRIAL GALVANIZING LINES

(71) Applicant: Cockerill Maintenance & Ingenierie S.A., Seraing (BE)

(72) Inventors: Michel Dubois, Boncelles (BE); Giuseppe Callegari, Warsage (BE)

(73) Assignee: COCKERILL MAINTENANCE & INGENIERIE S.A., Seraing (BE)

( * ) Notice: Subject to any disclaimer, the term of this patent is extended or adjusted under 35 U.S.C. 154(b) by 244 days.

(21) Appl. No.: 17/287,532

(22) PCT Filed: Oct. 14, 2019

(86) PCT No.: PCT/EP2019/077708
§ 371 (c)(1),
(2) Date: Apr. 22, 2021

(87) PCT Pub. No.: WO2020/083682
PCT Pub. Date: Apr. 30, 2020

(65) Prior Publication Data

US 2021/0381092 A1 Dec. 9, 2021

(30) Foreign Application Priority Data

Oct. 24, 2018 (EP) ..... 18202302

(51) Int. Cl.
*C23C 2/14* (2006.01)
*C23C 2/20* (2006.01)
(Continued)

(52) U.S. Cl.
CPC ..... *C23C 2/20* (2013.01); *C23C 2/02* (2013.01); *C23C 2/06* (2013.01); *C23C 2/12* (2013.01); *C23C 2/14* (2013.01)

(58) Field of Classification Search
CPC ..... C23C 2/02; C23C 2/14; C23C 2/20
See application file for complete search history.

(56) References Cited

U.S. PATENT DOCUMENTS 5,786,036 A * 7/1998 Pannenbecker ..... C23C 2/20 118/712
2004/0095584 A1 5/2004 Schyns et al.
2020/0047234 A1 2/2020 Yonekura et al.

FOREIGN PATENT DOCUMENTS

EP 1421330 B1 4/2008
WO WO 03019114 A1 3/2003
WO WO 2018150585 A1 8/2018

OTHER PUBLICATIONS

Nicolas Guelton, et al., "Cross Coating Weight Control by Electromagnetic Strip Stabilization at the Continuous Galvanizing Line of ArcelorMittal Florange", Metallurgical and Materials Transactions B, Aug. 18, 2016, pp. 2666-2680, vol. 47B, Springer New York LLC, New York, USA.

(Continued)

*Primary Examiner* — Hai Y Zhang
(74) *Attorney, Agent, or Firm* — Leydig, Voit & Mayer, Ltd.

(57) ABSTRACT

A method for controlling and optimizing a transverse uniformity of a coating thickness on at least one side of a running metal strip in an industrial galvanization installation, the coating being deposited by hot dip coating in a pot containing a liquid metal bath, includes at least the steps of: heating the strip substrate to a temperature higher than a pot temperature; passing the strip through the bath by wrapping the strip around at least a first deflector roll or sink roll followed by at least one second deflector roll, the second deflector roll improving a flatness of the strip; wiping excess coating thickness carried away by the strip on one or both sides of the strip by wiping nozzles blowing a gas on the (Continued)

strip at an exit of the liquid metal bath; and measuring an actual distance profile between the nozzles and the strip.

18 Claims, 9 Drawing Sheets

(51) Int. Cl.

| | |
|---|---|
| ***C23C 2/02*** | (2006.01) |
| ***C23C 2/06*** | (2006.01) |
| ***C23C 2/12*** | (2006.01) |

(56) References Cited

OTHER PUBLICATIONS

M Dubois, J Callegari, "Methodology to Quantify Objectively the Coating Weight Uniformity", AISTech 2016: Proceedings of the Iron & Steel Technology Conference, May 16-19, 2016, pp. 2121-2128, vol. 2, AIST: Association for Iron & Steel Technology, Pittburgh, Pennsylvania. USA.

* cited by examiner

METHOD FOR CONTROLLING A COATING WEIGHT UNIFORMITY IN INDUSTRIAL GALVANIZING LINES

CROSS-REFERENCE TO PRIOR APPLICATIONS

This application is a U.S. National Phase application under 35 U.S.C. § 371 of International Application No. PCT/EP2019/077708, filed on Oct. 14, 2019, and claims benefit to European Patent Application No. EP 18202302.8, filed on Oct. 24, 2018. The International Application was published in English on Apr. 30, 2020 as WO 2020/083682 under PCT Article 21(2).

FIELD

The present invention is related to improved and simplified methods for controlling the weight uniformity of a corrosion protective coating layer deposited in hot dip galvanizing lines.

BACKGROUND

The most usual method for controlling a coating thickness on a metal strip in continuous industrial galvanizing processes consists in using air-knife blowing of a gas on the liquid metal carried away by the running strip as it comes out of the pot containing the liquid metal generally used to be a mixture of zinc, aluminum and magnesium with some impurities at a content below 1%.

When the strip comes out of the reduction annealing furnace where it is heated quite close to the liquid metal temperature, it passes through the pot by firstly wrapping itself around a submerged deflector roll named sink roll and then around one or two smaller submerged rolls that have the function to correct the crossbow induced by the sink roll. It is known in the art that a suitable position of these smaller rolls can more or less correct the above-mentioned crossbow.

It is further known that the coating thickness (or weight) deposited on the metal strip mostly depends on the liquid properties, the blowing or wiping nozzles to strip distance, the nozzle opening through which the gas is blown, the nozzle exit gas velocity, the gas properties and the strip speed. Other variables like roughness of the substrate, or wiping height may also have an impact on the final coating thickness but the range of the latter is quite limited.

Good coating uniformity in the longitudinal and transverse directions respectively is an usual requirement of the customers for the quality of the product as well as for the operating costs. This is because the market usually asks for a minimum coating thickness so as to ensure minimum corrosion resistance while any extra coating will have additional cost for the producer. A 3 sigma coating weight is a classical requirement but some equipment manufacturers contend to be able to warranty 1 sigma of 1% of the average (0.5 g/m$^2$ on a 50 g/m$^2$).

It is also known that a transversal variation of the coating thickness occurs on each strip side, owing to non-constant nozzle to strip distance in the cross direction. This is indeed due to the fact that the strip is not perfectly flat in front of the nozzle whereas the nozzles line is perfectly straight. As a result the coating thickness is lower where the nozzle to strip distance is shorter.

FIG. 1 is a schematic view of a hot dip liquid pot 1 showing a typical situation with the moving strip 2, the sink roll 3, the smaller deflecting rolls 4, the nozzles on the first side 5 and on the second side 6. After having been heated and possibly been annealed and/or cooled in a furnace 7 to a temperature close to the liquid metal temperature, the strip 2 passes through the pot 1 and is deflected by the sink roll 3.

Then the strip further passes through one or both smaller rolls 4 that can be adjusted to determine the pass line at the pot exit, as well as to correct the strip crossbow shape induced by the sink roll 3. Various designs exist but the most usual is the one in which the middle roll also named corrector roll is moved back and forth by the operator until the strip shape is improved.

FIG. 2A schematically shows an example of strip shape at the nozzles location. It comes from that situation that the distance between nozzles 5 and the strip 2 and the distance between opposite nozzles 6 and the strip 2 respectively are as in FIG. 3. FIG. 2B shows a situation where one nozzle bar is skewed.

Dubois et al. (see below) have shown that the true nozzle to strip distance can be suitably fitted by an $n^{th}$ order polynomial function which actually is well approximated by a quartic function or polynomial function of $4^{th}$ degree/order such as $$\text{distance}\ (X)=A+B.X+C.X^2+D.X^3+E.X^4 \quad (1)$$

where X is the position from the center of the nozzle bar, A, B, C and D being parameters to be adjusted by the method of linear least squares. This method is called hereinafter the fourth order regression method.

A is the average or mean nozzle to strip distance while B is due to the skewness of the nozzle bar, which corresponds to the average slope of distance in function of X. C is related to the strip tile shape, a symmetric profile named crossbow or average bow across the strip width (C represents the average radius of the shape). Constants D and E are terms dedicated to model a specific shape possibly not symmetric like S shape or reverse curvature as observed in case of a W shape (or crossbow away from center shape).

From the theory, it turns up that, provided the nozzles are well designed and adjusted, achieving a uniform coating requires to obtain a nearly constant nozzle to strip distance all along the strip width. This is a difficult task for the operators in the line for the following reasons:

the nozzle to strip distance is difficult to measure all along the strip width owing to hostile environment, the strip width usually varying between 500 mm and 2200 mm and finally the brightness of the coated strip making not easy the use of lasers;

there are few actuators available to the operators in the line. Skewness is easy to correct if the nozzles can be moved and adjusted separately on each edge. Position of the small deflecting rolls in the pot can improve the transversal bow induced by the plastic deformation of the strip when wrapping itself around the bottom roll or sink roll. Presently there does not exist any valid model that can give the penetration of the corrector roll to set to compensate for the crossbow induced by the sink roll. Such a situation is due to the fact that the mechanical properties of the strip in the pot are not known owing to the high temperature and including the fact that the bending and unbending occurs in the elastoplastic domain, itself depending on the strip tension applied locally;

the right action to do on site is difficult to find in operation because if the A and B values of equation (1) can be easily corrected, the right correction to compensate for the crossbow is difficult owing to the fact that the actual strip shape is usually complex and cannot be modelled with accuracy by a simple polynomial of $2^{nd}$ order. Finally, usually, there is not on site any device really available to directly correct the strip shape at the nozzles separately for the 3rd and 4th order of equation (1).

Many correcting systems exist in prior art but they either use the inline coating gauge located about 120 m after the air knives or the measurement and control of the strip position at a close distance from the air knives. This method has the drawback not to give the exact nozzle to strip distance at the nozzles as it is known that the strip shape still changes as soon as it leaves the pot.

Document WO 2018/150585 A1 discloses a sheet-curvature correction device that uses magnetism to correct the sheet curvature of a steel sheet S being conveyed, said sheet-curvature correction device comprising: a plurality of electromagnets that are aligned in the sheet-width direction of the steel sheet S and face so as to sandwich the steel sheet S in the sheet-thickness direction; moving mechanisms that can move the electromagnets relative to the steel sheet S; and a control unit that controls the activity of the moving mechanisms on the basis of values for the current flowing in the electromagnets.

In N. GUELTON et al., "Cross coating weight control by electromagnetic strip stabilization at the continuous galvanizing line of ArcelorMittal Florange", Metallurgical and Materials Transaction B—Springer (2016) 47:2666-2680, the already existing coating weight control system, succeeding in eliminating both average and skew coating errors but not able to do anything against crossbow coating errors, has therefore been upgraded with a flatness correction function which takes advantage of the possibility of controlling the electromagnetic stabilizer. The basic principle is to split, for every gauge scan, the coating weight cross profile of the top and bottom sides into two respectively linear and non-linear components. The linear component is used to correct the skew error by realigning the knives with the strip, while the non-linear component is used to distort the strip in the stabilizer in such a way that the strip is kept flat between the knives.

In M. DUBOIS and J. CALLEGARI, "Methodology to Quantify Objectively the Coating Weight Uniformity", Iron & Steel Technology, AIST.org, February 2017, a standard easy-to-run methodology is proposed to compute not only the standard deviation per side but also quantities in relation to strip shape, nozzle adjustment, and other process and product parameters.

SUMMARY

In an embodiment, the present invention provides a method for controlling and optimizing a transverse uniformity of a coating thickness on at least one side of a running metal strip in an industrial galvanization installation, the coating being deposited by hot dip coating in a pot containing a liquid metal bath, the method comprising at least the steps of: heating the strip substrate to a temperature higher than a pot temperature; passing the strip through the bath by wrapping the strip around at least a first deflector roll or sink roll followed by at least one second deflector roll, the second deflector roll being configured to improve a flatness of the strip; wiping excess coating thickness carried away by the strip on one or both sides of the strip by wiping nozzles blowing a gas on the strip at an exit of the liquid metal bath; measuring an actual distance profile between the nozzles and the strip along a direction transverse with respect to a running strip direction, and in a vicinity of the nozzles, so as to obtain an actual nozzle to strip distance profile curve; using a computer to calculate a first correction on the nozzle to strip distance profile curve based on a calculation of an average slope, comprising a $1^{st}$ order linear regression straight line of the nozzle to strip distance profile curve, so as to apply the first correction based on a skewness of the nozzles and to set the nozzles parallel to the strip; calculating a second correction on the first corrected nozzle to strip distance profile curve by subtracting from the curve a $2^{nd}$ order linear regression quadratic line, a result thereof being a second corrected nozzle to strip distance profile curve, so as to apply the second correction to compensate for a crossbow by an adjustment of the deflector rolls in the pot; and acting on the nozzles' position and transverse metal strip shape by physically transposing on the industrial galvanization installation the first and second calculated corrections, as a first corresponding physical correction and a second corresponding physical correction, by modifying firstly the position of the nozzles and secondly the shape of the strip respectively, so as to obtain a coated strip which is physically corrected in position and shape.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
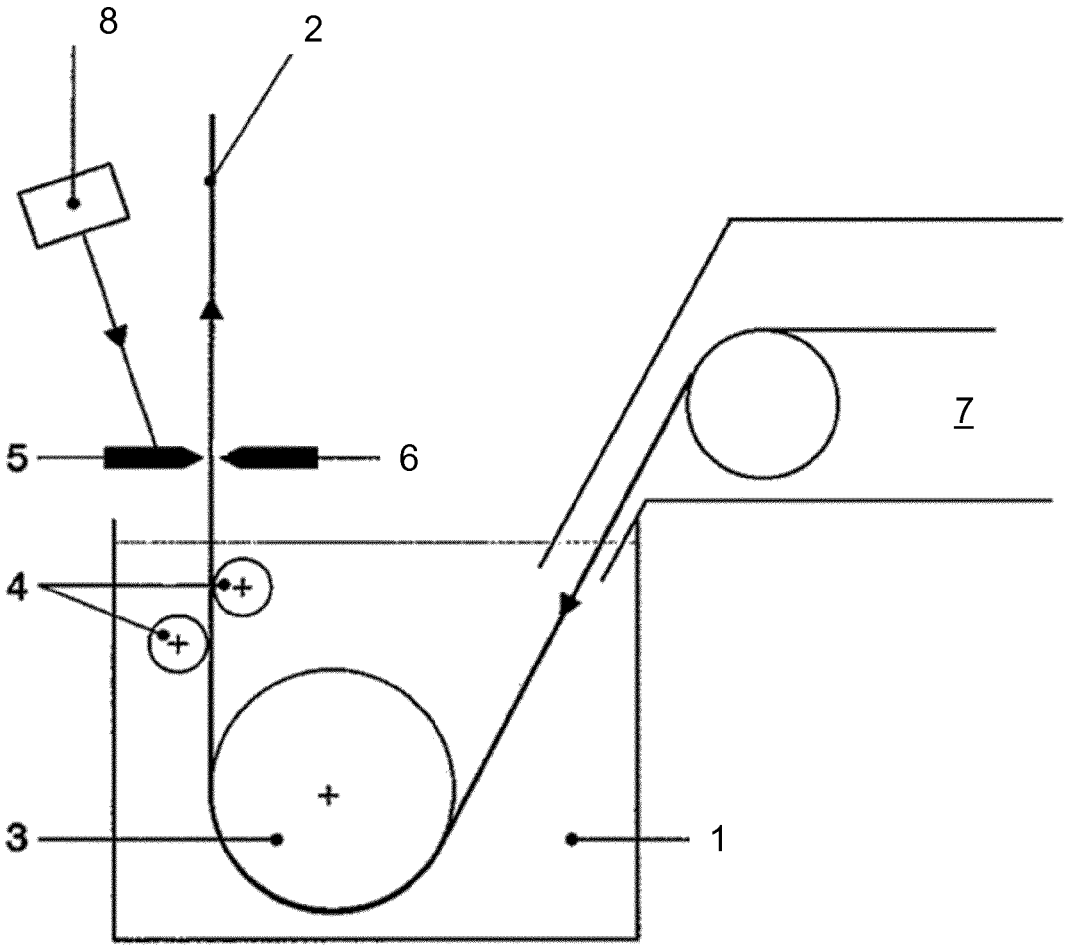
FIG. 1 schematically represents a hot dip galvanization installation according to prior art and provided with an optical distance measurement head.

In an embodiment, the present invention provides an ability to reduce the nozzle to strip distance variations along the width of the strip from correcting by suitable means these distance variations due to imperfect strip shape and vibrations and further to provide an industrial method for improving the coating weight uniformity in hot dip galvanizing installations.

In an embodiment, the present invention provides a methodology for controlling the operating parameters to reach a flat strip at the wiping nozzles.

The present invention relates to a method for controlling and optimizing the transverse uniformity of a coating thickness on at least one side of a running metal strip in an industrial galvanization installation, said coating being deposited by hot dip coating in a pot containing a liquid metal bath, said hot dip coating comprising at least the steps of:

heating the metal strip substrate to a temperature higher than the pot temperature;

passing the metal strip through the bath by wrapping it around at least a first deflector roll or sink roll followed by at least one second deflector roll, said second deflector roll being intended to improve the flatness of the strip;

wiping excess coating thickness carried away by the running strip on one or both sides of the strip by wiping nozzles blowing a gas on the coated strip at the exit of the liquid metal bath;

if this additional equipment is available in the installation, passing the metal strip through a contactless actuator system located after the nozzles, said contactless actuator system being able to exert a force on the running strip for modifying the position and/or shape of the strip; said method comprising at least the steps of:

measuring an actual distance profile between the nozzles and the strip along the direction transverse in respect of the running strip direction, and in the vicinity of the nozzles, so as to obtain an actual nozzle to strip distance profile curve;

using a computer, calculating a first correction on the nozzle to strip distance profile curve based on the calculation of the average slope, that is $1^{st}$ order linear regression straight line of the nozzle to strip distance profile curve, aimed at applying said first correction to take into account the skewness of the nozzles and to set the nozzles parallel to the metal strip; and calculating a second correction on the first corrected nozzle to strip distance profile curve by subtracting from said curve a $2^{nd}$ order linear regression quadratic line, the result being a second corrected nozzle to strip distance profile curve, aimed at applying said second correction to compensate for the crossbow by the adjustment of the deflector rolls in the pot;

acting on the nozzles position and transverse metal strip shape by physically transposing to the industrial galvanization installation the first and second calculated corrections, as a first and second corresponding physical corrections, by modifying firstly the position of the nozzles and secondly the shape of the metal strip respectively, so that to obtain a coated metal strip which is physically corrected in position and shape;

if said additional equipment is available, further acting on the coated metal strip which is physically corrected in position and shape, using the contactless actuator system, as a third physical correction, so that to obtain a coated metal strip having optimized flatness.

According to preferred embodiments, the method further comprises at least one of the following characteristics, or a suitable combination of several of these characteristics:

the first, second and third physical corrections are performed step by step and sequentially;

the first and second physical corrections are performed manually by an operator or are automatically controlled by an actuator control process;

the contactless actuator system is a magnetic actuator system;

the actual nozzle to strip distance profile is measured by a contactless sensor system;

the contactless sensor system is an optical head comprising one or more lasers and cameras;

the step of physically modifying the position of the nozzles is a nozzle skewness correction;

the step of physically modifying the shape of the metal strip comprises modifying the position of the second deflector roll in the pot, so that to reduce the crossbow of the metal strip after passing the sink roll in the hot dip bath;

when there is only one second deflector roll, the step of physically modifying the shape of the metal strip comprises modifying the position either of the sink roll or of the second deflector roll in the pot, the other roll being stationary, in order to modify the relative position of the sink roll to the second deflector roll;

in the third physical correction, the contactless actuator system is driven to finalize the correction of the strip position and shape at the nozzle location vicinity to reach a standard deviation of the corrected actual distance profile with respect to perfect flatness close to zero;

the third physical correction is performed by the contactless actuator system with respect to the second corrected nozzle to strip distance profile curve fitted by a $4^{th}$ order or higher order linear regression;

the third physical correction performed using the contactless actuator system is performed manually or is automatically controlled by a control process;

the actual nozzle to strip distance profile is measured by the contactless sensor system at less than 100-150 mm from the wiping zone, the contactless actuator system being located between 0.5 and 5 m from the wiping zone;

the hot dip coating further comprises, after the step of heating the metal strip substrate to a temperature higher than the pot temperature, a step of cooling of the strip to a controlled temperature before entering the pot;

the method is applied to control and optimize the transverse uniformity of coating thickness in the case of a steel strip dip coated in a bath of zinc, aluminium, magnesium or any mixture thereof, possibly with additional elements selected from the group consisting of Si, Sb, Pb, Ti, Ca, Mn, Sn, La, Ce, Cr, Zr and Bi, the content thereof being lower than 1% of the total composition weight.

The present invention relates to a measurement of the true nozzle to strip distance on the full strip width combined with a strategy to carry out a number of corrections on the nozzle position, on the geometry of the pot rolls and advantageously by using contactless actuators like electromagnetic actuators preferably located between 0.5 and 2 meter from the air knives to further correct the flatness of the strip.

In particular, the present invention is the combination of the following elements.

Figure 3:
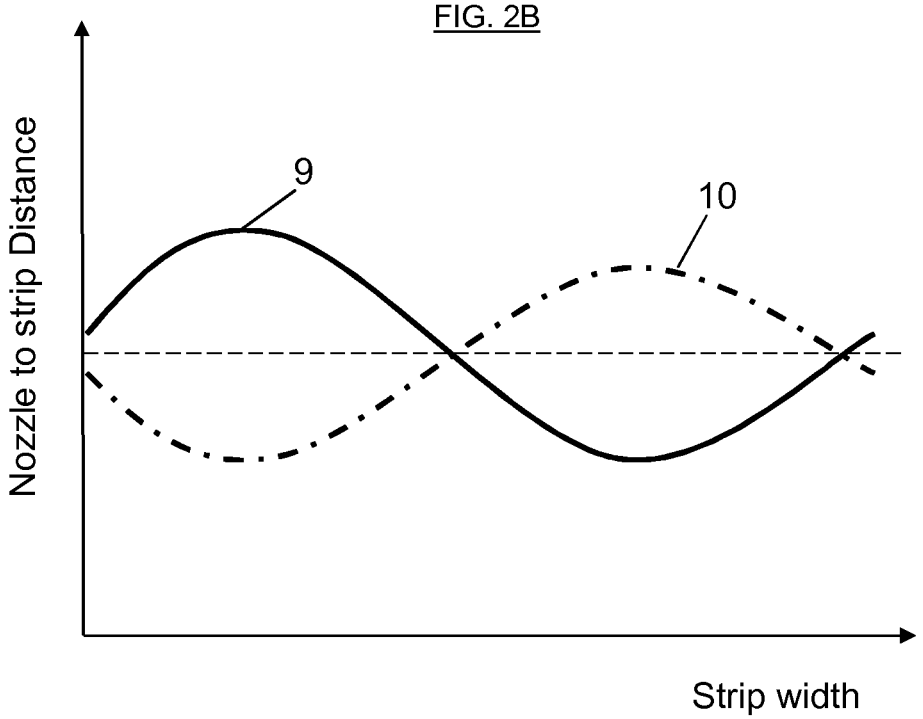
FIG. 3 represents an example of the nozzle to strip distance plot according to the transverse position from the center of the metal strip (possibly fitted with a polynomial curve of $4^{th}$ order).

Firstly one or more measuring devices are provided for measuring the nozzle to strip distance all along the strip width on one or two sides of the steel strip (see FIG. 3). The measuring device will preferably be optical, using a number of cameras that allow to see the full strip width. The image(s) continuously collected in line is (are) processed to extract the complete strip profile of the nozzle to strip distance. Using optical measurement means such as cameras advantageously allows to measure the distance nozzle to strip at less than 100-150 mm of the wiping line and permits to avoid measurements possibly in the electromagnetic actuator zone.

The two profiles in FIG. 3 are symmetric as they are seen from the first and second nozzle bars 5, 6 respectively.

Optionally, a fitting of the nozzle to strip distance measurement points, the latter being related to the strip shape, can be performed preferably using above-mentioned $4^{th}$ order polynomial regression method. The necessary physical corrections to be applied to the moving strip in order to restore a flat strip shape are described hereinafter.

Figure 2A:
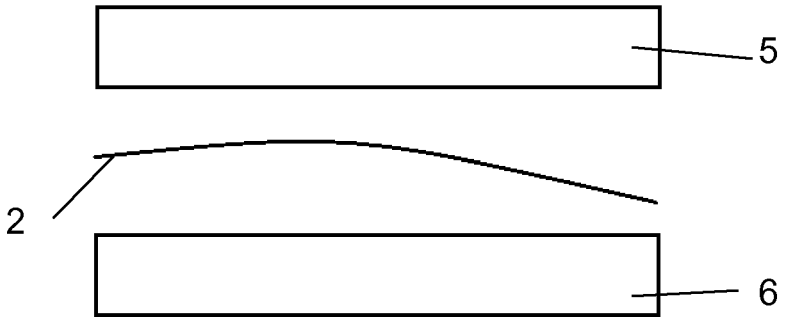
FIG. 2A and FIG. 2B schematically represent the metal strip surrounded by wiping nozzles bars, respectively parallel and skewed.
Figure 2B:
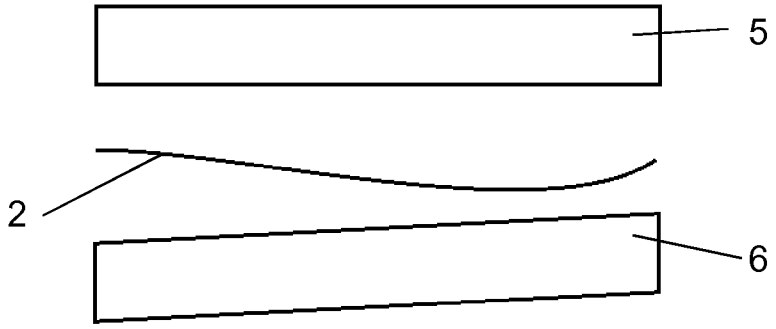

A first correction is then either proposed to the operator or alternately done automatically for taking into account the skewness of the nozzles (B-term in equation (1), see FIGS. 2A and 2B) resulting in setting them parallel to the metal strip (use of a first actuator).

Further, sequentially, a second correction is either proposed to the operator or alternately done automatically on the small submerged roll(s) in the pot to compensate for the crossbow. In practice this means that the adjustment of the small roll(s) position is performed until the average measured crossbow, or C-term in equation (1), is close to zero (use of a second actuator).

When the strip comes out of the pot, it passes through the pair of air knives 5, 6 and finally in a box of actuators that can apply contactless forces on the running strip. Such actuators will preferably be electromagnets (see below) due to their well-known performance in such applications (use of a third actuator).

Thus the final drive under the form of a contactless actuator box comprising a magnetic system is applied, located over the nozzles or air knives pair at a distal position from the strip, typically between 500 mm and 5 meters, but preferable between 500 mm and 2 meters. This device comprises a number of electromagnetic actuators located across the strip and is used in order to finalize the strip shape correction for reaching a strip shape having flatness ideally close to perfect flatness in front of the wiping nozzles. A methodology is carried out to separately drive each of the electromagnetic actuators across the transverse direction in order to modify the local force acting on the strip and further to reach a defined strip position at the nozzle locations, independently of the strip location between the magnets.

Figure 4:
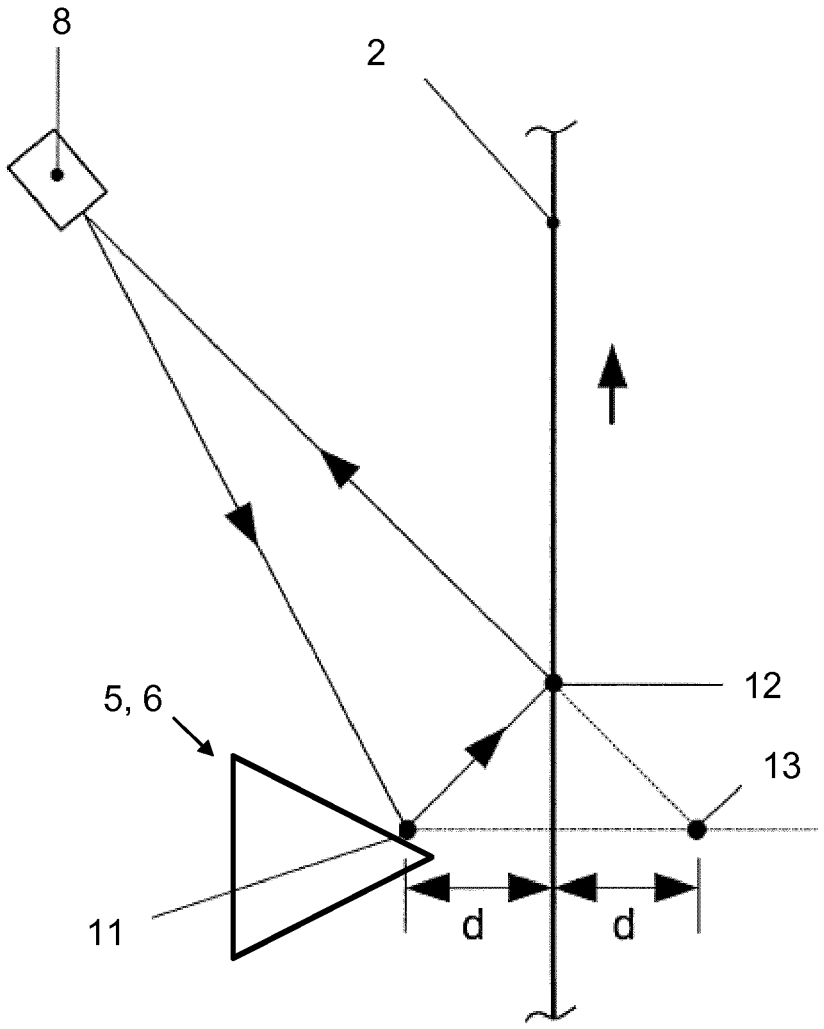
FIG. 4 represents an embodiment for the distance measurement device showing the reflection of the laser beam respectively on the wiping knives support and on the bright metal strip.
Figure 5A:
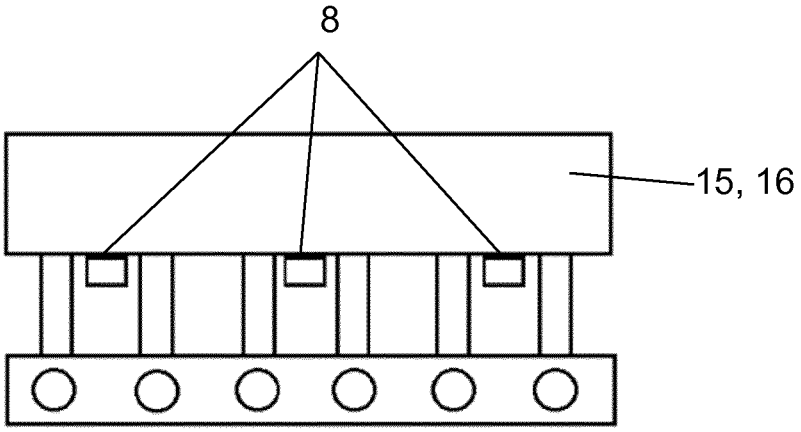
FIG. 5A and FIG. 5B schematically represent two respective embodiments for installing the distance measurement cameras on a real wiping nozzles support/casing.
Figure 5B:
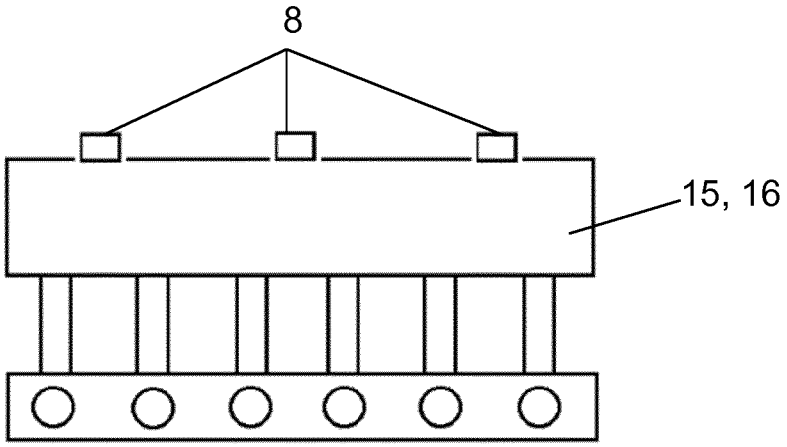

According to some embodiments, an optical system comprising one or more cameras 8 is located to see, transversally to the running direction of the strip, both the nozzles 5, 6 and the wiping line, as schematically shown on FIGS. 1 and 4. The cameras 8 may be installed on the devices respectively supporting the wiping air knives 15, 16 for example as shown on FIGS. 5A and 5B or even on a separate support provided that the cameras 8 are capable to suitably measure the nozzle to strip distance. The cameras 8 are preferably installed between the individual nozzles as shown on FIGS. 5A and 5B as well, and for example at a distance up to 2 meters over the nozzles, but more preferably about one meter over the nozzles. The wiping line can be easily identified on the metal strip for example by processing the image obtained by the optical device including the cameras in order to identify the variation of brightness of the strip, as it is known that the strip surface between the pot and the nozzles is quite dull due to the liquid turbulence whereas the strip surface becomes bright at the location where the coating thickness has been adjusted. Another usable method could be to observe the reflection of a projected laser line on the wiped surface as described for example in patent EP 1 421 330 B1 (see FIG. 4). Thanks to a calibration, one can be able to know the real position 11 in mm of the detector or camera corresponding to a first reflection of the laser beam. The laser beam is further reflected at position 12 on the strip, which gives the real position of virtual image 13 in the horizontal plane of the first reflection. The ordinate of the strip point having produced a given image corresponds to the midpoint of the ordinates of the two images (see FIG. 4).

According to some embodiments, the numbers of cameras 8 used will depend on the distance between their location and the nozzle lip as well as on the strip width. A typical number will be 2 cameras for a 1000 m width strip when the cameras are located at about one meter from the wiping line. The appropriate selection of the camera number is however matter of case-by-case identification in relation with the particular design and space available.

The cameras can be installed on each side of the strip but this is not necessary. According to some embodiment, the cameras are installed on only one side of the strip. In this case, the strip to nozzle distance on the other side is obtained by computing the difference between the nozzle to nozzle distance and the sum of the strip to nozzle distance on the camera side and the strip thickness.

According to other embodiments, some calibration devices may be used on the nozzles, or alternately a calibration procedure at the maintenance shop, in order to be able to get the exact nozzle to strip distance in millimeters based on the pictures made by the cameras.

Figure 6:
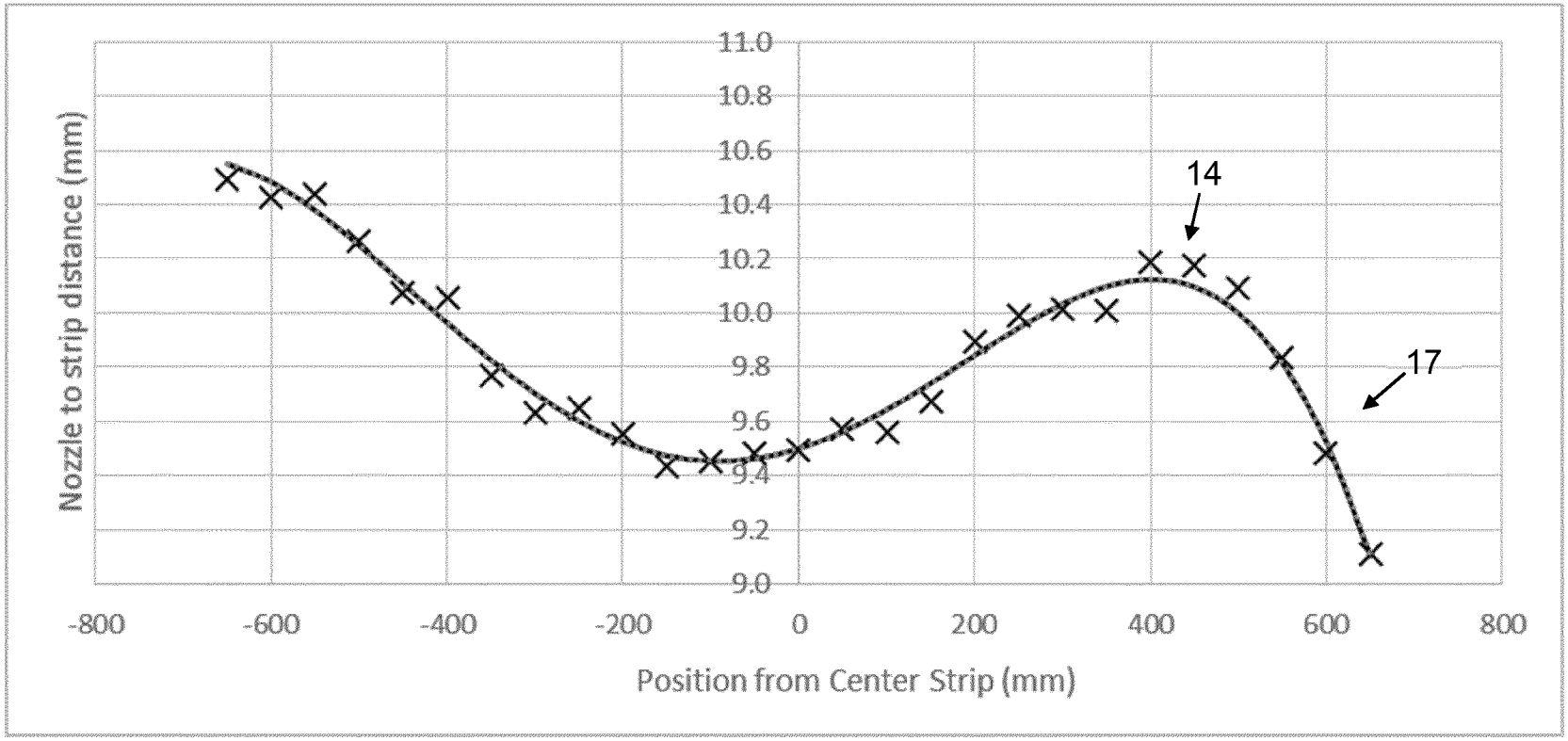
FIG. 6 shows an example of the nozzle to strip distance plot according to the transverse position from the center of the metal strip as measured (crosses) and fitted or interpolated (solid line).

Once the complete transverse nozzle to strip distance measurements have been obtained on one or two strip sides, a mathematical treatment is carried out to decompose the profile in separate terms, ideally according to the four polynomial terms of equation (1). For example, FIG. 6 shows a typical transverse distance profile actually measured. Of course it seems to be a very bad case which is obtained when operators are not very sensitive to the uniformity of the coating weight. The crosses 14 on FIG. 6 are for example representing the nozzle to strip distance truly measured at known or determined positions. If there are too few measured points (crosses 14), solid line 17 can be obtained for example by mathematical fitting or by interpolation.

Figure 7:
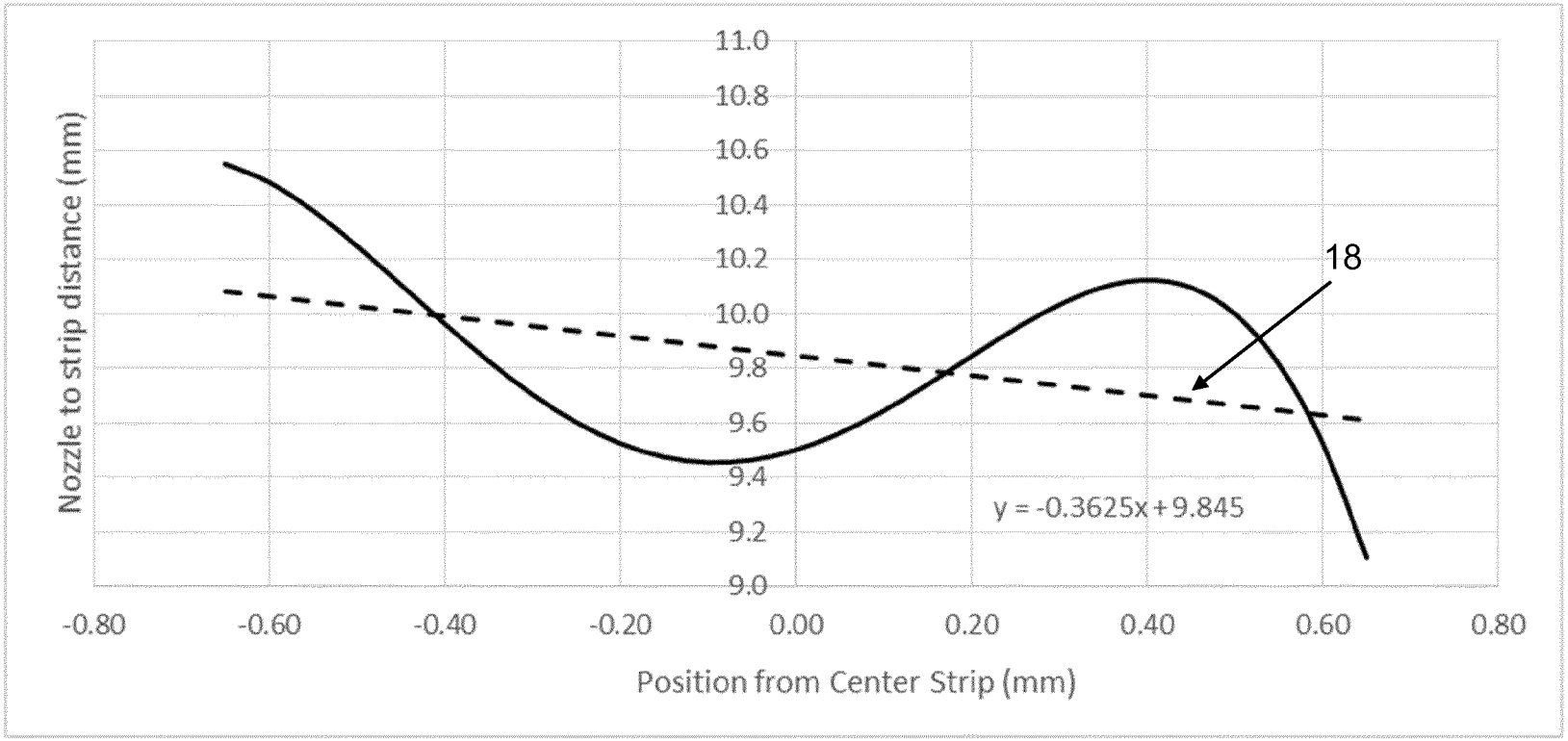
FIG. 7 shows a first order regression (straight line) of the data of FIG. 6 giving the skewness (dotted line).

The first step of the correcting process according to the invention consists in removing the skewness of the above-mentioned distance profile. For that purpose, the mean slope of the distance profile is computed, by performing a linear regression with a straight line (see FIG. 7, mean slope is dotted line 18). In the example above, one obtains a skewness or mean slope of 0.36 mm/meter.

Figure 8:
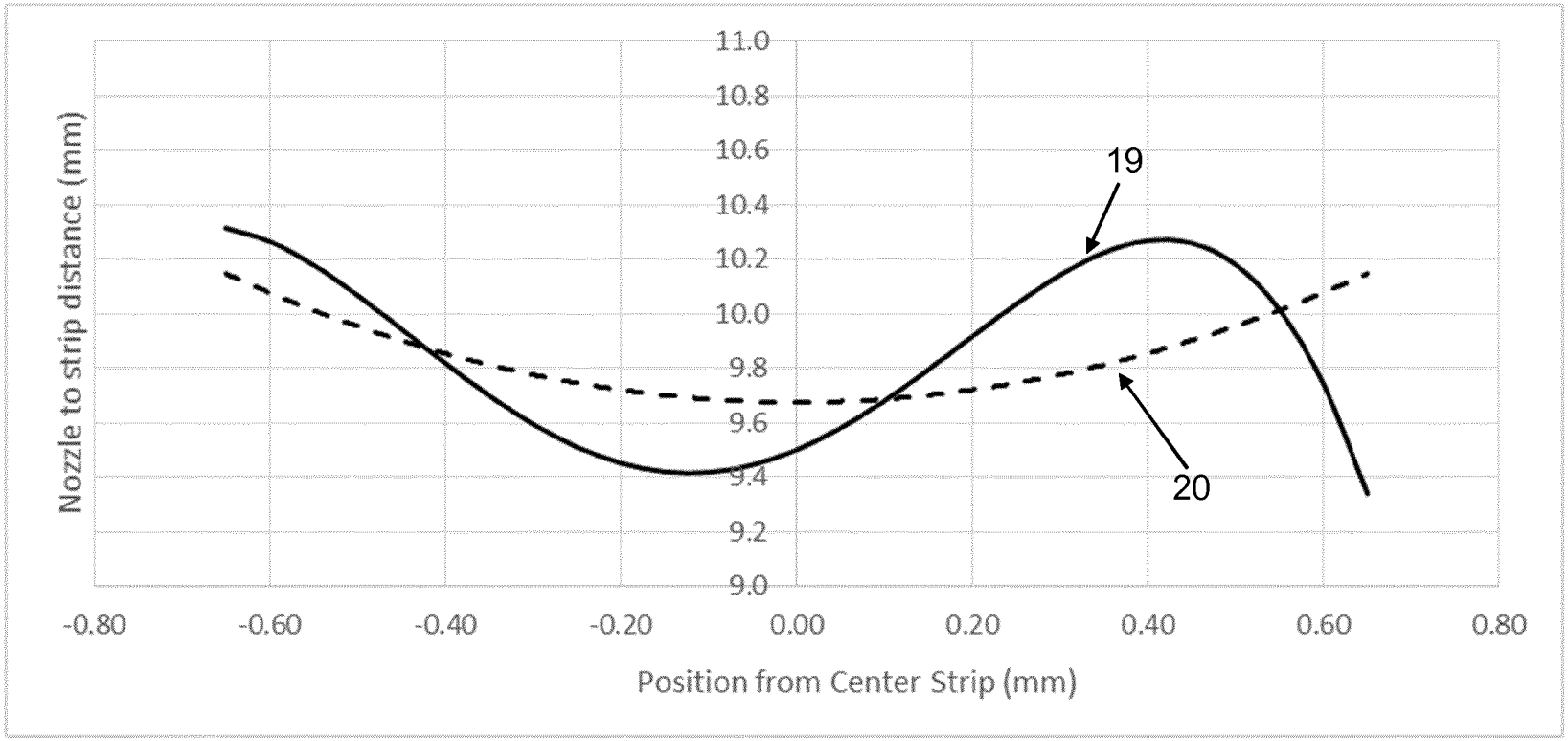
FIG. 8 shows the correction of the curve of FIG. 6 for the skewness as computed in FIG. 7 (solid line) and the second order regression of this corrected curve (dotted line).

The first correction is then applied on the installation, based on the above-mentioned computed slope, either manually by the operator correcting the skewness of the strip regarding the wiping nozzles position, or automatically (see FIG. 8, corrected distance as solid line 19).

Further a regression fit is performed with a second order component curve (see FIG. 8, second order component is dotted line 20).

Figure 9:
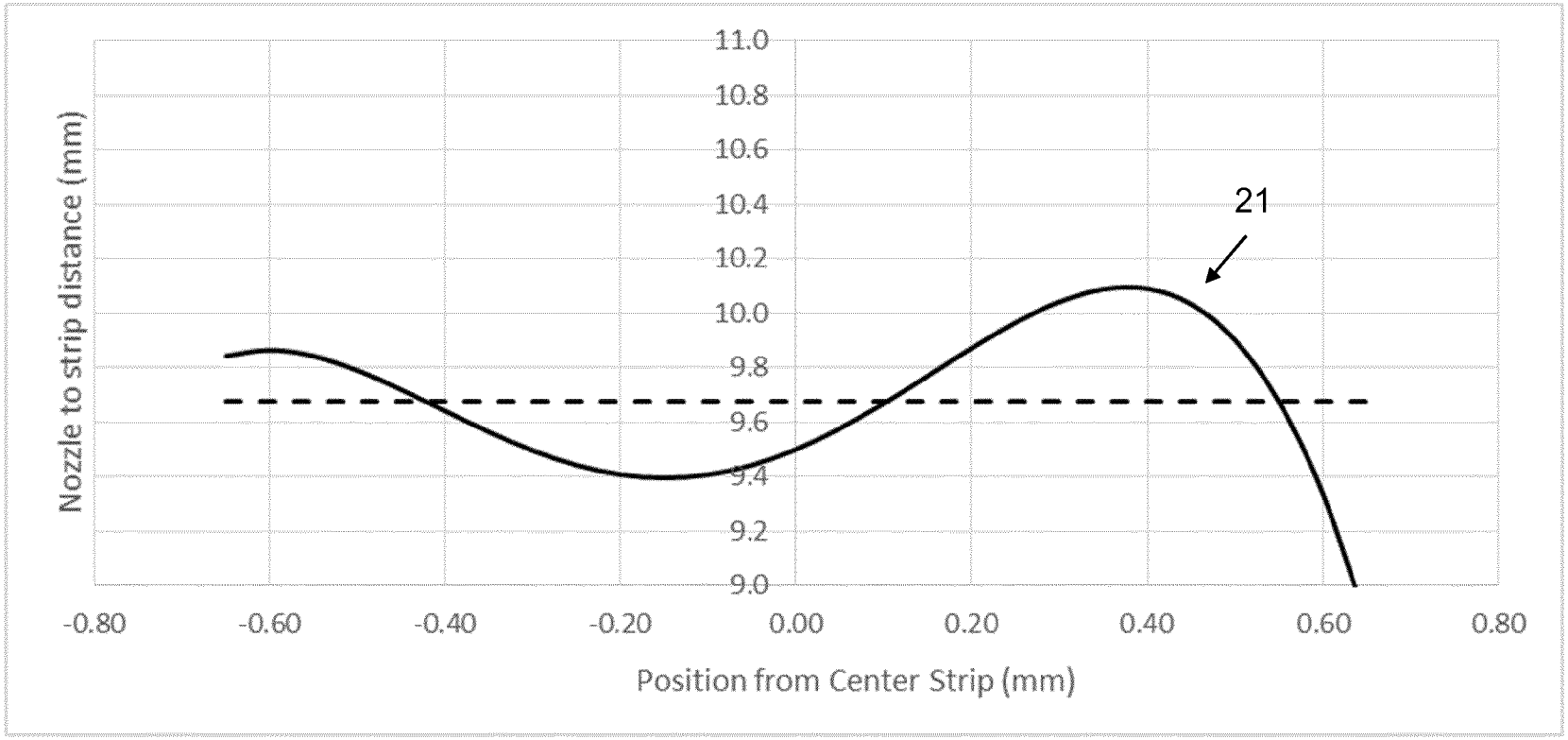
FIG. 9 shows the correction of the curve of FIG. 8 for the second-order term representing the crossbow of the strip (solid line). The horizontal dotted line would represent perfect flatness of the strip in case there would be no higher order polynomial term(s) in the strip shape.

In order to physically remove this second order term, the pot correcting roll(s) acting as a second actuator is (are) adjusted to correct and possibly remove the $2^{nd}$ order of the profile (see FIG. 9, corrected distance is solid line 21).

In order ideally to remove the third and fourth degree polynomial contributions to the distance profile, the contactless actuator located after the nozzles will then be used to change the position of the strip transversally (i.e. at specific transverse locations). In the example shown on FIG. 10, a contactless actuator with five (electro)magnets 22 is used for a typical strip width and nozzle to strip distance shape.

Considering that the profile here is seen from the front side of the pot (each magnet being supposed to attract the strip) and that the front side of the strip is also the front side of the pot:

magnet M1 is located on the front side of the strip and will attract the strip with increased intensity (compared with average) to reduce the nozzle to strip distance on the front side;

magnet M2 is located on the back side of the strip and will have low attraction on the strip to increase the nozzle to strip distance on the front side;

magnet M3 is located on the back side of the strip and will attract more the strip (compared to M2) to increase the nozzle to strip distance on the front side;

magnet M4 is located on the front side of the strip and will attract the strip on the front side to reduce the nozzle to strip distance on the front side;

magnet M5 is located on the back side of the strip and will strongly attract the strip to increase the nozzle to strip distance on the front side.

Note that the position of the magnets either on the front side or on the back side of the strip is in this example purely arbitrary and any other position of the magnets than in this example also falls under the scope of the present invention.

Preferably, at each measurement point, there are oppositely mounted magnets corresponding to the two sides, but only one magnet is active.

Figure 10:
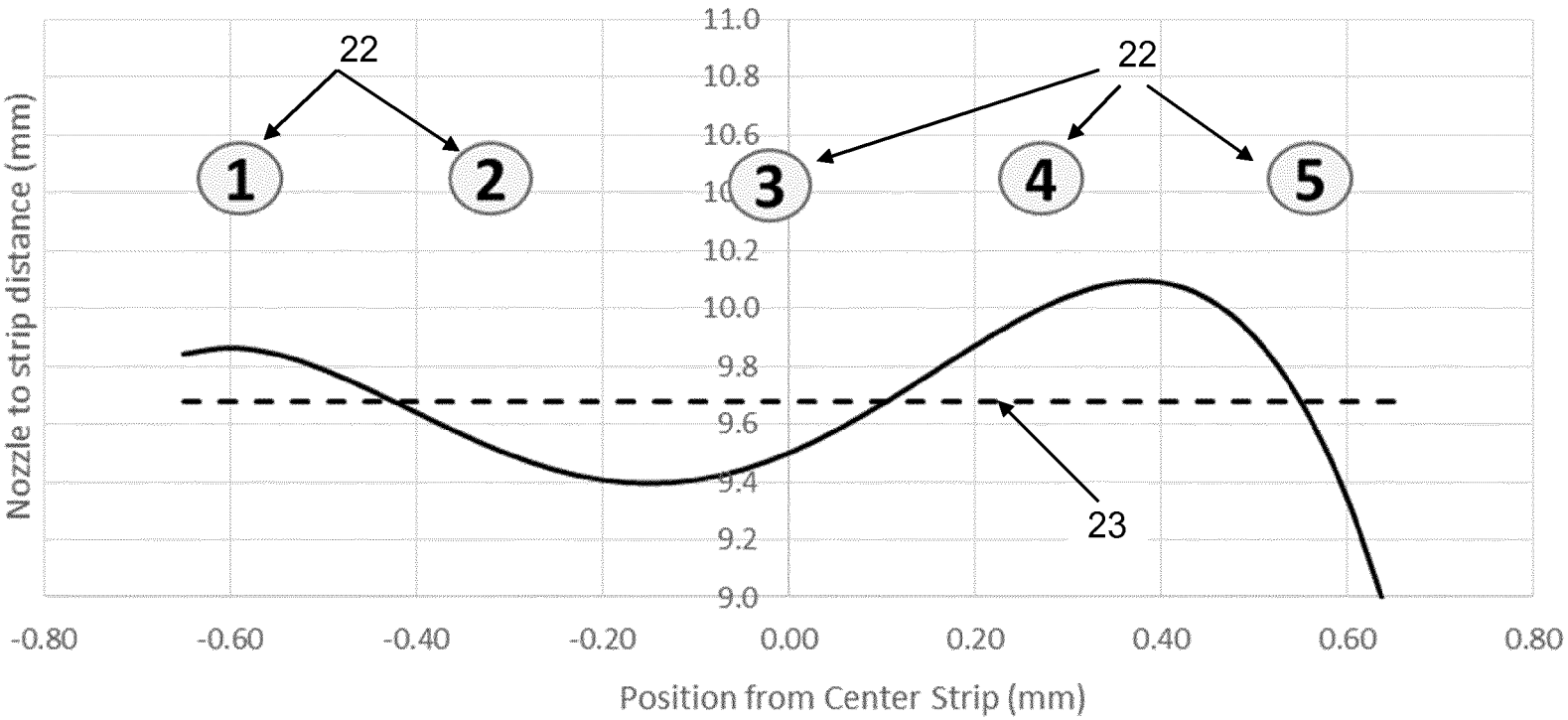
FIG. 10 represents the case where the higher order polynomial terms of the curve of FIG. 8 have been corrected globally using 5 magnetic actuators arranged equidistantly on the width of the strip.

After suitable action of the five magnetic actuators, the nozzle to strip distance is optimized, and is ideally constant along the width of the strip (see dotted horizontal line in FIG. 10).

The force of (and so the current intensity sent to) the electromagnets is based on the true measured position of the strip. This means that the optical detection system has to firstly measure the true nozzle to strip distance to correct the distance profile on a step by step base.

It may happen that the optimized action on the strip cannot lead to total or perfect flatness at the end of the process. The best results obtained by the invention system should be obtained only when the geometry of the pot rolls is perfect and when the operator sets the right parameters for wiping. This explains why the correction optimization during steps 1 and 2 respectively on skewness and roll position is a priority before the magnets are possibly used for further correction.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

1 Liquid metal pot
2 Moving strip
3 Sink roll
4 Deflecting roll(s)
5 First wiping nozzle bar
6 Second wiping nozzle bar
7 Reduction annealing furnace
8 Optical head with laser source and camera (or any optical sensor/detector)
9,10 Nozzle to strip distance (resp. seen from nozzle bar 5 or 6)
11 First laser reflection point (on wiping nozzle casing)
12 Second laser reflection point (on bright running strip)
13 Virtual point corresponding to second reflection point
14 Nozzle to strip distance measurement points
15, 16 Wiping nozzle casing (feeding pipe)
17 Nozzle to strip distance fitting ($4^{th}$ order regression)
18 First order regression
19 Distance curve corrected for skewness
20 Second order regression
21 Distance curve corrected for second-order shape defect (crossbow)
22 Electromagnetic actuators
23 Final distance curve corrected by electromagnetic actuators

The invention claimed is:

1. A method for controlling and optimizing a transverse uniformity of a coating thickness on at least one side of a running metal strip in an industrial galvanization installation, the coating being deposited by hot dip coating in a pot containing a liquid metal bath, the method comprising at least the steps of:

heating the strip substrate to a temperature higher than a pot temperature;

passing the strip through the bath by wrapping the strip around at least a first deflector roll or sink roll followed by at least one second deflector roll, the second deflector roll being configured to improve a flatness of the strip;

wiping excess coating thickness carried away by the strip on one or both sides of the strip by wiping nozzles blowing a gas on the strip at an exit of the liquid metal bath;

measuring an actual distance profile between the nozzles and the strip along a direction transverse with respect to a running strip direction, and in a vicinity of the nozzles, so as to obtain an actual nozzle to strip distance profile curve;

using a computer, to calculate a first correction on the nozzle to strip distance profile curve based on a calculation of an average slope, comprising a $1^{st}$ order linear regression straight line of the nozzle to strip distance profile curve, so as to apply the first correction based on a skewness of the nozzles and to set the nozzles parallel to the strip;

calculating a second correction on the first corrected nozzle to strip distance profile curve by subtracting from the curve a $2^{nd}$ order linear regression quadratic line, a result thereof being a second corrected nozzle to strip distance profile curve, so as to apply the second correction to compensate for a crossbow by an adjustment of the deflector rolls in the pot; and acting on the nozzles' position and transverse metal strip shape by physically transposing on the industrial galvanization installation the first and second calculated corrections, as a first corresponding physical correction and a second corresponding physical correction, by modifying firstly the position of the nozzles and secondly the shape of the strip respectively, so as to obtain a coated strip which is physically corrected in position and shape.

2. The method according to claim 1, wherein the first and second physical corrections are performed manually by an operator or are automatically controlled by an actuator control process.

3. The method according to claim 1, wherein the contactless actuator system comprises a magnetic actuator system.

4. The method according to claim 1, wherein the actual nozzle to strip distance profile is measured by a contactless sensor system.

5. The method according to claim 4, wherein the contactless sensor system comprises an optical head comprising one or more lasers and cameras-.

6. The method according to claim 4, wherein the actual nozzle to strip distance profile is measured by the contactless sensor system at less than 100-150 mm from a wiping zone, the contactless actuator system being located between 0.5 and 5 m from the wiping zone.

7. The method according to claim 1, wherein the step of physically modifying the position of the nozzles comprises a nozzle skewness correction.

8. The method according to claim 1, wherein the step of physically modifying the shape of the metal strip comprises modifying the position of the second deflector roll in the pot, so as to reduce the crossbow of the strip after passing the sink roll in the hot dip bath.

9. The method according to claim 8, wherein, when there is only one second deflector roll, the step of physically modifying the shape of the strip comprises modifying the position either of the sink roll or of the second deflector roll in the pot, an other of the two rolls being stationary, in order to modify a relative position of the sink roll with respect to the second deflector roll.

10. The method according to claim 1, wherein the hot dip coating further comprises, after the step of heating the metal strip substrate to a temperature higher than the pot temperature, a step of cooling of the strip to a controlled temperature before entering the pot.

11. The method according to claim 1, wherein the method is applied to control and optimize the transverse uniformity of coating thickness for a steel strip dip coated in the bath, the bath comprising zinc, aluminium, magnesium, or any mixture thereof.

12. The method according to claim 11, wherein the bath further comprises additional elements selected from a group consisting of Si, Sb, Pb, Ti, Ca, Mn, Sn, La, Ce, Cr, Zr, and Bi, a content thereof being lower than 1% of a total composition weight.

13. The method according to claim 1, further comprising:

passing the strip through a contactless actuator system located after the nozzles, the contactless actuator system being configured to exert a force on the strip to modify a position and/or shape of the strip.

14. The method according to claim 13, further comprising:

further acting on the coated strip which is physically corrected in position and shape, using the contactless actuator system, as a third physical correction, so as to obtain a coated metal strip having optimized flatness.

15. The method according to claim 14, wherein the first, second and third physical corrections are performed step by step and sequentially.

16. The method according to claim 14, wherein, in the third physical correction, the contactless actuator system is driven to finalize a correction of the strip position and shape at the nozzle location vicinity to reach a standard deviation of the corrected actual distance profile with respect to perfect flatness close to zero.

17. The method according to claim 16, wherein the third physical correction is performed by the contactless actuator system with respect to the second corrected nozzle to strip distance profile curve fitted by a 4th order or higher order linear regression.

18. The method according to claim 14, wherein the third physical correction performed using the contactless actuator system is performed manually or is automatically controlled by a control process.

* * * * *